US010625293B2

(12) United States Patent
Frey

(10) Patent No.: US 10,625,293 B2
(45) Date of Patent: Apr. 21, 2020

(54) COMPONENT DELIVERY SYSTEM UTILIZING FILM BAGS

(71) Applicant: NORDSON CORPORATION, Westlake, OH (US)

(72) Inventor: Charles M. Frey, Groton, CT (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 16/407,337

(22) Filed: May 9, 2019

(65) Prior Publication Data

US 2019/0262857 A1 Aug. 29, 2019

Related U.S. Application Data

(60) Continuation of application No. 15/898,186, filed on Feb. 15, 2018, now Pat. No. 10,525,500, which is a continuation of application No. 15/361,681, filed on Nov. 28, 2016, now Pat. No. 9,968,959, which is a continuation of application No. 14/928,042, filed on (Continued)

(51) Int. Cl.

| | |
|---|---|
| ***B05C 17/005*** | (2006.01) |
| ***B05C 17/015*** | (2006.01) |
| ***B65D 81/32*** | (2006.01) |

(52) U.S. Cl.

CPC .. *B05C 17/00559* (2013.01); *B05C 17/00516* (2013.01); *B05C 17/00583* (2013.01); *B05C 17/015* (2013.01); *B65D 81/325* (2013.01); *B05C 17/00553* (2013.01)

(58) Field of Classification Search

CPC ..... B05C 17/00559; B05C 17/00516; B65D 81/325

See application file for complete search history.

(56) References Cited

U.S. PATENT DOCUMENTS

| | | | |
|---|---|---|---|
| 1,479,781 | A | 1/1924 | Bartholo et al. |
| 1,560,352 | A | 11/1925 | Sheppard |

(Continued)

FOREIGN PATENT DOCUMENTS

| | | | |
|---|---|---|---|
| EP | 0541972 | A1 | 5/1993 |
| EP | 0754633 | A2 | 1/1997 |

(Continued)

*Primary Examiner* — Donnell A Long

(74) *Attorney, Agent, or Firm* — Baker & Hostetler LLP

(57) ABSTRACT

A compressible cartridge includes a first flexible bag, a second flexible bag, and a rigid face plate. The first and second flexible bags include a multilayer film having at least three layers formed from different materials. The first and second flexible bags have a front end and a sealed back end opposite the front end. The first flexible bag defines a first volume to receive a first flowable material. The second flexible bag defines a second volume to receive a second flowable material that is different from the first flowable material. The rigid face plate has a first collar, a second collar, and a nosepiece. The first collar is bonded to the front end of the first flexible bag, and the second collar is bonded to the front end of the second flexible bag. The nosepiece defines 1) a first opening that is in fluid communication with the first volume of the first flexible bag, 2) a second opening that is in fluid communication with the second volume of the second flexible bag, and 3) a discharge opening.

18 Claims, 20 Drawing Sheets

Related U.S. Application Data

Oct. 30, 2015, now Pat. No. 9,517,488, which is a continuation-in-part of application No. 14/191,612, filed on Feb. 27, 2014, now abandoned, which is a division of application No. 12/378,312, filed on Feb. 13, 2009, now abandoned, which is a continuation-in-part of application No. 11/027,552, filed on Dec. 30, 2004, now abandoned.

(56) References Cited

U.S. PATENT DOCUMENTS

| | | | | |
|---|---|---|---|---|
| 1,690,306 | A | 11/1928 | Mieg | |
| 1,735,509 | A | 11/1929 | Shoji | |
| 1,779,770 | A | 10/1930 | Harrington | |
| 1,951,876 | A | 3/1934 | Lapsley | |
| 2,595,708 | A | 5/1952 | Salfisberg et al. | |
| 3,323,682 | A | 6/1967 | Creighton et al. | |
| 3,643,837 | A | 2/1972 | Green | |
| 3,782,600 | A * | 1/1974 | Columbus | B65D 35/38 222/94 |
| 3,796,460 | A | 3/1974 | Potchen | |
| 3,892,908 | A | 7/1975 | Lovness | |
| 4,189,065 | A | 2/1980 | Wolf-Dietrich | |
| 4,227,612 | A | 10/1980 | Dillon | |
| 4,338,048 | A | 7/1982 | Murphy et al. | |
| 4,340,154 | A | 7/1982 | Vanmanen | |
| 4,353,463 | A | 10/1982 | Seemann | |
| 4,392,589 | A | 7/1983 | Wolf-Dietrich | |
| 4,479,781 | A | 10/1984 | Herold et al. | |
| 4,560,352 | A | 12/1985 | Neuemeister et al. | |
| 4,676,410 | A | 6/1987 | Von Flue | |
| 4,687,663 | A | 8/1987 | Schaeffer | |
| 4,690,306 | A | 9/1987 | Staeheli | |
| 4,735,509 | A | 4/1988 | Rausch | |
| 4,779,770 | A | 10/1988 | Wolf-Dietrich | |
| 4,951,876 | A | 8/1990 | Mills | |
| 5,002,623 | A | 3/1991 | Steer et al. | |
| 5,020,693 | A | 6/1991 | Ernst et al. | |
| 5,129,244 | A | 7/1992 | Wittman | |
| 5,184,757 | A | 2/1993 | Giannuzzi | |
| 5,228,599 | A * | 7/1993 | Keller | B05C 17/00513 222/137 |
| 5,241,130 | A | 8/1993 | Shibukawa | |
| 5,256,723 | A | 10/1993 | Hense et al. | |
| 5,257,450 | A | 11/1993 | Tamura | |
| 5,273,190 | A | 12/1993 | Lund | |
| 5,332,122 | A | 7/1994 | Herold et al. | |
| 5,360,146 | A | 11/1994 | Ikushima | |
| 5,370,282 | A | 12/1994 | Sedlmeier | |
| 5,405,056 | A | 4/1995 | Mills | |
| 5,443,181 | A | 8/1995 | Popp et al. | |
| 5,454,129 | A | 10/1995 | Kell | |
| 5,494,190 | A | 2/1996 | Boettcher | |
| 5,531,546 | A | 7/1996 | Herdlicka et al. | |
| 5,543,611 | A | 8/1996 | Andrews | |
| 5,566,860 | A | 10/1996 | Schiltz et al. | |
| 5,593,066 | A | 1/1997 | Konuma et al. | |
| 5,647,510 | A | 7/1997 | Keller | |
| 5,697,524 | A * | 12/1997 | Sedlmeier | B01F 13/002 222/105 |
| 5,796,460 | A | 8/1998 | Maturaporn | |
| 5,873,970 | A | 2/1999 | Konuma et al. | |
| 5,892,908 | A | 4/1999 | Hughes et al. | |
| 5,993,720 | A | 11/1999 | Konuma et al. | |
| 6,129,244 | A | 10/2000 | Hoerth | |
| 6,158,621 | A | 12/2000 | Keller | |
| 6,241,130 | B1 | 6/2001 | Heiberger | |
| 6,257,450 | B1 | 7/2001 | Jackson et al. | |
| 6,454,129 | B1 | 9/2002 | Green | |
| 6,543,611 | B1 | 4/2003 | Peuker et al. | |
| 6,547,510 | B1 | 4/2003 | Beaulieu | |
| 6,796,460 | B2 | 9/2004 | Ichikawa et al. | |
| 6,892,908 | B2 | 5/2005 | Ichikawa et al. | |
| 2003/0005973 | A1 | 1/2003 | Watanabe et al. | |
| 2003/0168479 | A1 | 9/2003 | Lu et al. | |
| 2004/0178225 | A1 | 9/2004 | Ichikawa et al. | |
| 2005/0006413 | A1 | 1/2005 | Miyata et al. | |
| 2005/0138792 | A1 | 6/2005 | Black et al. | |
| 2005/0147761 | A1 | 7/2005 | Parks et al. | |
| 2006/0144854 | A1 | 7/2006 | Clemens et al. | |
| 2006/0188314 | A1 | 8/2006 | Hunter et al. | |
| 2007/0007307 | A1 | 1/2007 | Bohnisch et al. | |
| 2009/0272767 | A1 | 11/2009 | Herman et al. | |
| 2014/0174037 | A1 | 6/2014 | Frey | |
| 2016/0045928 | A1 | 2/2016 | Frey | |

FOREIGN PATENT DOCUMENTS

| | | | |
|---|---|---|---|
| EP | 0754663 | A1 | 1/1997 |
| EP | 0787661 | A1 | 8/1997 |
| EP | 1209098 | A1 | 5/2002 |
| GB | 2246172 | A | 1/1992 |
| GB | 2259868 | A | 3/1993 |
| WO | 91/07333 | A1 | 5/1991 |

* cited by examiner

COMPONENT DELIVERY SYSTEM UTILIZING FILM BAGS

CROSS REFERENCE TO RELATED APPLICATIONS

The present application is a continuation of U.S. patent application Ser. No. 15/898,186, filed Feb. 15, 2018, which is a continuation of U.S. patent application Ser. No. 15/361,681, filed Nov. 28, 2016, which is a continuation of U.S. patent application Ser. No. 14/928,042, filed Oct. 30, 2015, which is a continuation-in-part of U.S. patent application Ser. No. 14/191,612, filed Feb. 27, 2014, which is a divisional of U.S. patent application Ser. No. 12/378,312, filed Feb. 13, 2009, which is a continuation-in-part of U.S. patent application Ser. No. 11/027,552, filed Dec. 30, 2004, all of which are herein incorporated by reference in their entireties.

BACKGROUND OF THE INVENTION

The present invention relates to component packs for the dispensing of various components via a dispenser, particularly to component packs employing a pair of film bags containing flowable compositions which are to be admixed when ejected from the dispenser, and more particularly to a component delivery system employing the pair of film bags.

Various compositions are packaged in tubular cartridges for use in caulking guns and other types of dispensing mechanisms. In some instances, the dispensing mechanisms will take two or more cartridges side-by-side so that the contents of the cartridges are dispensed simultaneously and admixed in a mixer as they flow towards the point of deposition. Typically, such cartridges have employed tubes of plastic, or coated or laminated paperboard, and the like. Moreover, the tubes generally have been filled through one end of the tube after which a closure is placed thereover. Using such side-by-side cartridges to dispense two components involves a substantial amount of waste and expense.

In recent years there has been considerable activity in cartridges comprising film bags within a cylindrical shell. Exemplary of such cartridges are those disclosed in Keller U.S. Pat. No. 5,647,510, and the several embodiments proposed by Konuma et al, U.S. Pat. No. 5,593,066.

Although such cartridges have represented an improvement from the standpoint of ease of use, generally the structures have been relatively complicated to fabricate and relatively costly. Obtaining good seals between the bags and the face piece of the cartridge has been a problem. Filling of the film bags and their handling has often presented a problem in automated equipment.

An embodiment provides a novel film pack container for dispensing components which is relatively simple to fabricate easy to fill and relatively trouble free during the dispensing operation.

An embodiment provides a dispensing system which is relatively economical to fabricate and which permits dispensing of the contents at several different times.

An embodiment provides such a dispensing system which is readily adapted to different ratios of the components.

An embodiment provides such a dispensing system which can be filled after assembly of the bags and the face plate.

An embodiment provides a method and mold for securing the face plate to the film bag.

An embodiment provides a flexible component delivery system utilizing film bags.

SUMMARY OF THE INVENTION

It has now been found that the foregoing and related objects may be readily attained in a film pack container including an integrally molded synthetic resin face plate having a discharge opening and a nosepiece on one face extending about the opening. At least one flexible synthetic resin bag has one end sealingly adhered to the other face of the face plate about the discharge opening, and the other ends of the bags are sealed.

Preferably, the face plate has a flange on the other face which extends about the opening, and one end of each of the bags is sealingly adhered to the flange. The bags and the face plate are preferably fabricated from substantially the same synthetic resin to obtain a good bond.

The face plate is over molded on the film bag to produce an integrated structure of essentially uniform composition in which the bag is disposed inwardly of the face plate and there are no distinct layers in the interface.

In one embodiment, a pair of film pack bags each have one end adhered to the face plate in side-by-side registry with a portion of the discharge opening, and the discharge opening has a divider extending therein so that the contents of the bags remain separated as they pass through the opening. The nosepiece has a partition therein aligned with the divider in the opening to maintain separation of contents passing thereinto.

In another embodiment, the opening has a generally circular periphery and the face plate includes a generally circular divider supported within the opening to provide a generally annular peripheral portion of the opening and a generally circular portion spaced centrally thereof. One of the bags is of annular configuration and has the one end sealingly adhered to the face plate about the peripheral portion of the discharge opening, and the other of the bags has a circular cross section and is disposed in the center of the annular bag and in sealing engagement with the circular divider. The face plate has a nosepiece thereon extending from the discharge opening and a circular partition corresponding to the divider to maintain separation of the contents passing thereinto.

The film pack containers are filled with flowable compositions and will normally have a sealing cap on the end of the nosepiece which is replaced by a static mixer when discharging the contents.

In use, the filled film bag container is mounted in a dispenser including a housing with a dispensing end, a tubular sleeve, and a shuttle is movable in the sleeve towards the dispenser end. The film pack which is disposed in the tubular sleeve can be removed so that the sleeve can be reused.

In a method for producing dispenser packs of flowable compositions, a generally tubular flexible synthetic resin bag is supported on a mandrel, and the mandrel and bag are inserted into a mold providing a cavity about the end of the mandrel and bag; the cavity is configured to provide the face plate and nosepiece. Molten synthetic resin of substantially the same composition as that of the bag is injected into the cavity to form a face plate with the end of the bag sealingly adhered to the inner face thereof. The face plate has a discharge opening therein and a nosepiece about the opening is aligned with the end of the bag. The face plate, bag and mandrel are received from the cavity, the bag and face plate are removed from the mandrel, and the end of the bag spaced from the face plate is sealed. A flowable composition is injected through the nosepiece and opening in the face plate and into the bag, and a sealing cap is mounted on the nosepiece.

In one embodiment, a pair of synthetic resin bags are mounted on a pair of mandrels which are cooperatively configured and cooperate to define a generally circular cross section when placed in a cylindrical sleeve. The mold cavity and mandrels are configured to provide a partition in the opening in the face place and a nosepiece separating the contents of the two bags as the compositions in the bags flow therethrough. Flowable compositions are injected into each of the bags through the nosepiece.

In another embodiment, a pair of synthetic resin bags are mounted on a pair of mandrels, one of which is annular cross section and the other is of circular cross section and disposed within the annular mandrel. The mold cavity is configured to provide a face plate with a partition in the opening and nosepiece separating the contents of the two bags as the composition in the bags flow therethrough.

In another embodiment, an apparatus for dispensing a flowable material includes: at least two cylindrical sleeves each having a front end and a back end; at least two shuttles slidingly disposed internal of and proximate the back end of respective ones of the at least two cylindrical sleeves; at least two push rods disposed in operable communication with respective ones of the at least two shuttles; and, at least one piston disposed in operable communication with the at least two push rods, the at least one piston configured and adapted to be driven by a pressurized gas. The front end of respective ones of the at least two cylindrical sleeves are configured and adapted to receive individual ones of two flexible film pack bags having a common rigid face plate, the face plate having a discharge nosepiece integrally formed therewith, the discharge nosepiece having a partition internally disposed and configured to maintain separate flow streams from respective ones of the two flexible film pack bags. A holder is disposed proximate the front end of respective ones of the at least two cylindrical sleeves, the holder configured and adapted to restrain the face plate during dispensing of the flowable material. A mixer is configured and adapted to be in fluid communication with the flow streams from respective ones of the two flexible film pack bags. A material applicator is disposed in fluid communication with and on a downstream side of the mixer. A first flexible tube is disposed in fluid communication with and on an upstream side of the mixer. A second flexible tube is disposed in fluid communication with the material applicator for supplying atomization air to the material applicator via the pressurized gas.

In another embodiment, an apparatus for dispensing a flowable material includes: at least two cylindrical sleeves each having a front end and a back end; two flexible film pack bags, each film pack bag being disposed within respective ones of the at least two cylindrical sleeves, the two flexible film pack bags having an integrally formed common rigid face plate that is bonded to each of the two flexible film pack bags, the face plate having a discharge nosepiece integrally formed therewith, the discharge nosepiece having a partition internally disposed and configured to maintain separate flow streams from respective ones of the two flexible film pack bags; at least two shuttles slidingly disposed internal of and proximate the back end of respective ones of the at least two cylindrical sleeves; at least two push rods disposed in operable communication with respective ones of the at least two shuttles; at least one piston disposed in operable communication with the at least two push rods, the at least one piston configured and adapted to drive the at least two push rods; the front end of respective ones of the at least two cylindrical sleeves configured and adapted to receive individual ones of the two flexible film pack bags; a holder disposed proximate the front end of respective ones of the at least two cylindrical sleeves, the holder configured and adapted to restrain the face plate during dispensing of the flowable material; a mixer configured and adapted to be in fluid communication with the flow streams from respective ones of the two flexible film pack bags; and a material applicator disposed in fluid communication with and on a downstream side of the mixer.

DETAILED DESCRIPTION OF THE ILLUSTRATED EMBODIMENT

Figure 2:
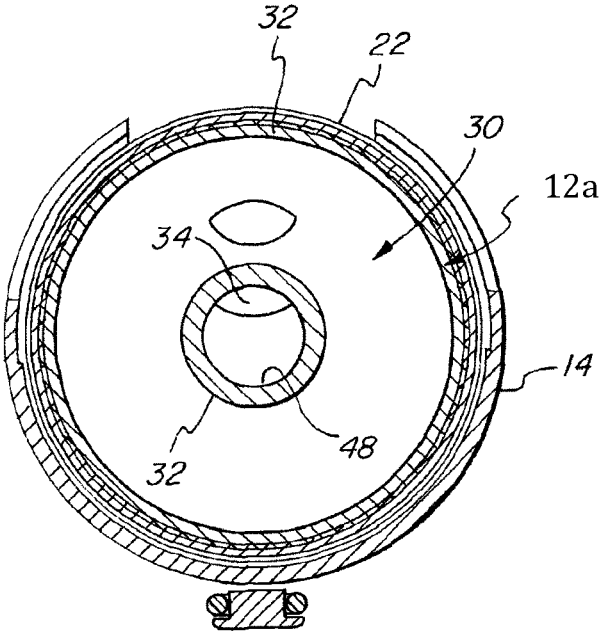
FIG. 2 is a sectional view the film pack container and dispenser along the line 2-2 of FIG. 1.
Figure 1:
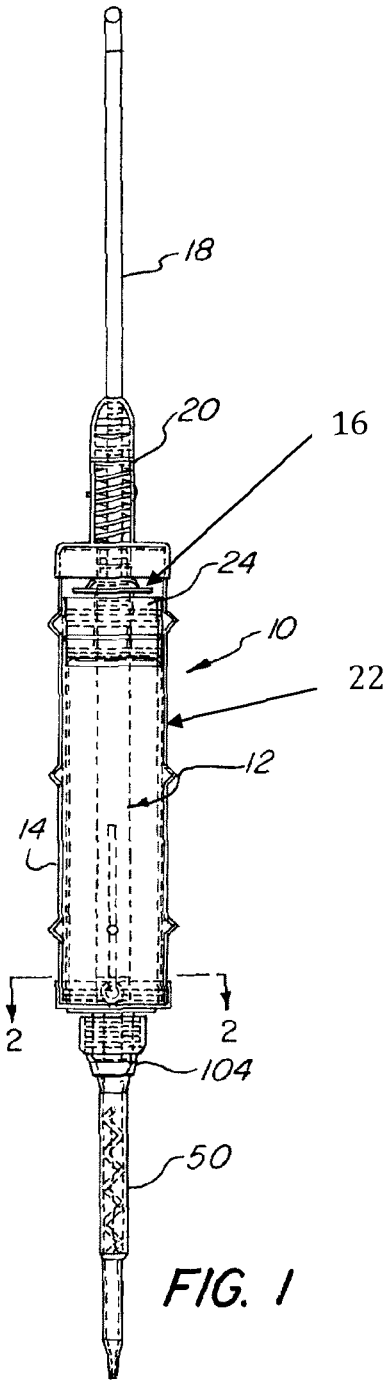
FIG. 1 is a longitudinal view in partial section of a cartridge dispenser in which there is seated a film pack container in accordance with an embodiment of the invention.
Figure 3:
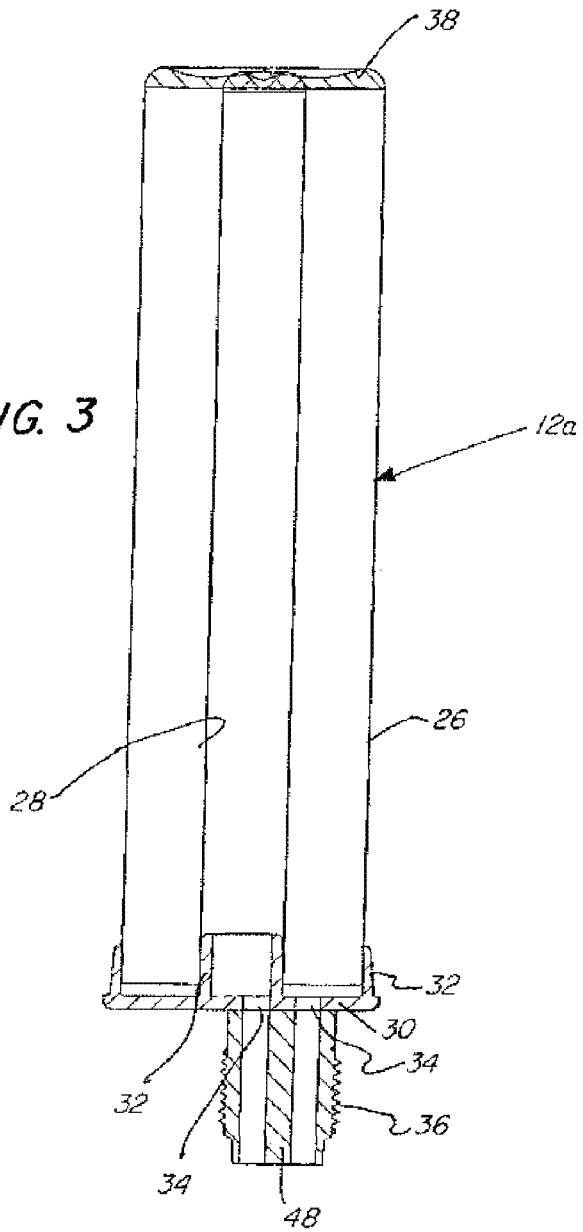
FIG. 3 is a longitudinal sectional view of the film pack container of FIG. 1.

Turning first to FIG. 1, therein illustrated a conventional caulking gun generally designated by the numeral 10 in which is seated a filled film bag container embodying an embodiment of the invention and generally designated by the numeral 12 (also herein referred to as film pack container). The caulking gun 10 has an arcuate housing 14, an end plate 16, a piston/rod 18 and an actuator assembly 20. Disposed in the housing 14 is the film bag container 12 which is supported in the cylindrical sleeve 22, and a cylindrical shuttle 24 which is moved in the sleeve 22 against the film bag container 12 by the piston/rod 18.

Turning next to FIGS. 2-5, therein illustrated is a film bag container 12*a* embodying an embodiment of the invention in which there is an outer annular bag 26, an inner cylindrical bag 28 and a face plate generally designated by the numeral 30 to which one end of the film bags 26, 28 are adhered. The face plate 30 has rearwardly projecting flanges 32 which provide the surface to which the film bags 26, 28 are adhered, and a discharge opening generally designated by the numeral 34. Extending about the discharge opening 34 and extending forwardly is a nosepiece generally designated by the numeral 36. The opposite ends of the film bags 26, 28 are sealed as indicated by the cross hatching 38.

Figure 4A:
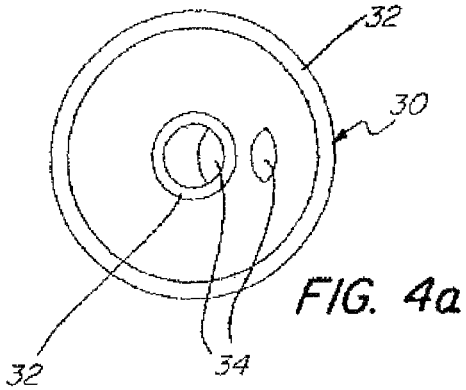
FIG. 4*a* is a rear view of the face plate of the film pack container shown in FIGS. 2 and 3.
Figure 4:
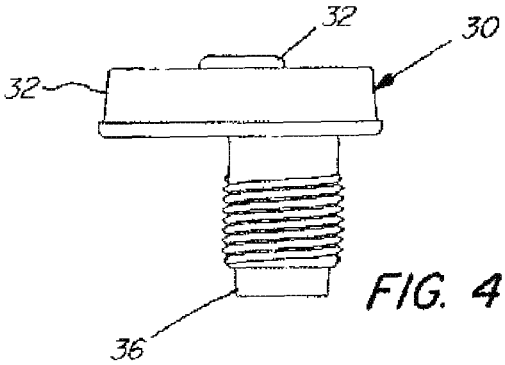
FIG. 4 is a side elevational view of a face plate of the film pack container.
Figure 5:
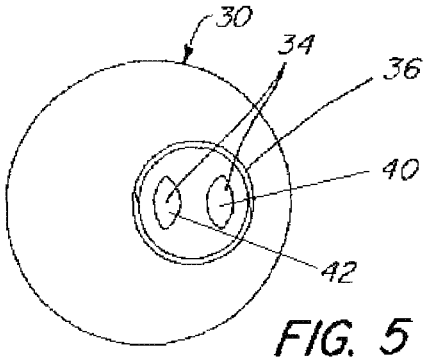
FIG. 5 is a front view of the face plate of the film pack shown in FIGS. 2 and 3.

As seen in FIGS. 4 and 5, the discharge opening 34 in the face plate 30 allows the contents of the film bag 26 to flow through the portion 40, and the contents of the film bag 28 flow through the portion 42.

The passage through the nosepiece 36 has a partition 48 which maintains the separation of the two streams until they enter the static mixer generally designated by the numeral 50 and which is secured onto the nosepiece 36.

Figure 6:
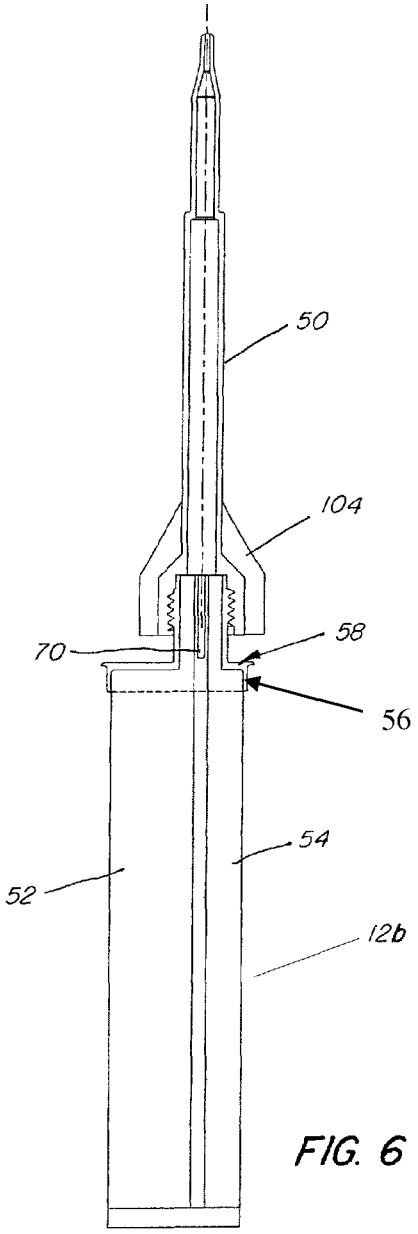
FIG. 6 is a longitudinal sectional view of an alternate embodiment of the film pack container in accordance with an embodiment of the invention.
Figure 8:
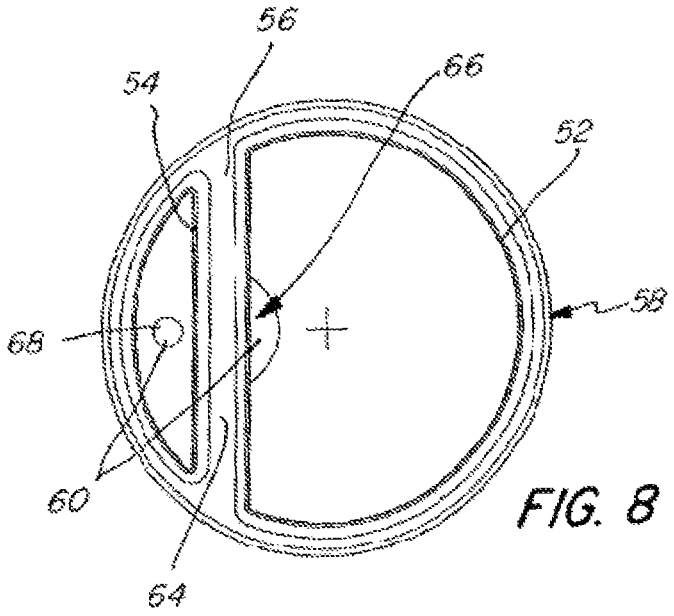
FIG. 8 is a rear view of the face plate of FIG. 6.
Figure 7:
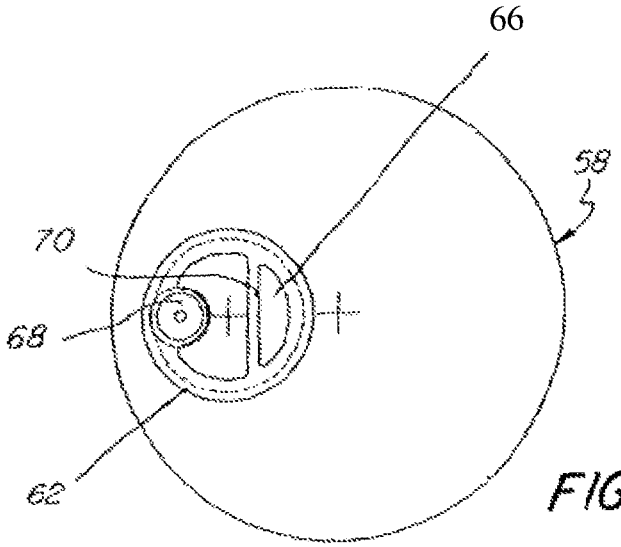
FIG. 7 is a front view of the face plate of FIG. 6.

Turning next to FIGS. 6-8, this film bag container 12*b* has a pair of generally cylindrical film bags 52,54 of different cross sectional area (about 3:1, for example but not limited to such). One end is adhered to the flanges 56 of the face plate generally designated by the numeral 58. As in the first embodiment, there is a discharge opening generally designated by the numeral 60 and a nosepiece 62 which extends thereabout. The opening 60 has a partition 64 so that the contents of the film bag 52 flow through the portion 66 and the contents of the film bag 54 flow through the portion 68. The nosepiece 62 has a cooperating and aligned partition 70, and the opposite ends of the film bags are sealed as indicated by the numeral 72.

Figure 9:
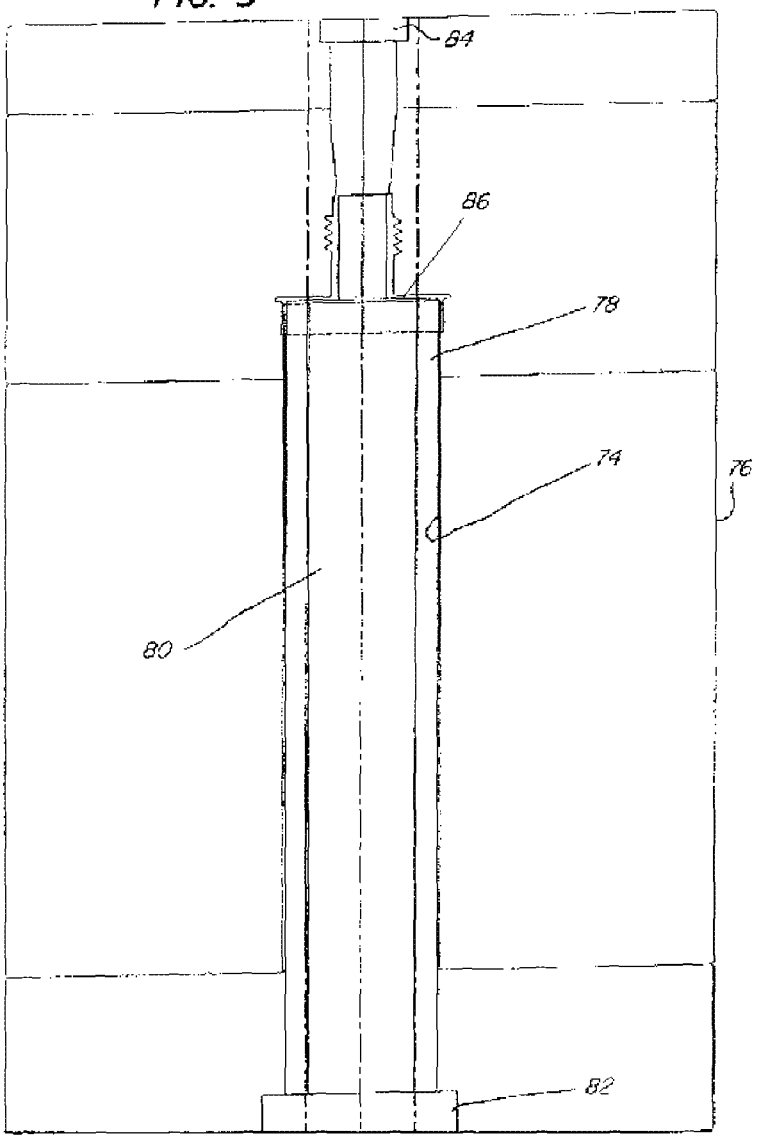
FIG. 9 is a diagrammatic view of film bags mounted on coaxial mandrels and disposed within a mold to form the face plate.

Turning next to FIG. 9, therein schematically illustrated is the mold assembly for integrally molding the face plate 30 about the ends of the coaxial film bags 26, 28 and bonding the components in assembly. Seated in a complimentary cavity 74 in a mold 76 are an annular mandrel 78 and a coaxial cylindrical mandrel 80 upon which are slidably supported the annular film bag 26 and the cylindrical film bag 28. The mandrels 78, 80 are supported on the base 82, and a secondary core 84 extends downwardly to cooperate with the mandrels 78, 80 to provide a cavity portion 86 corresponding to the configuration desired for the face plate 30.

Molten synthetic resin is injected into the cavity portion 86 through runners (not shown) to produce the desired face plate 30 including the flanges 32, discharge opening 34 and nosepiece 36. The molten resin heats the exposed end portions of the film bags 26, 28 to effect a strong bond between the film bags 26, 28 and face plate 30. After cooling, the mold 76 is opened and the mandrel fixture is withdrawn. The film bags 26, 28 are slid off the mandrels 78, 80 and the opposite ends of the film bags are sealed to provide an empty film pack container.

Figure 10:
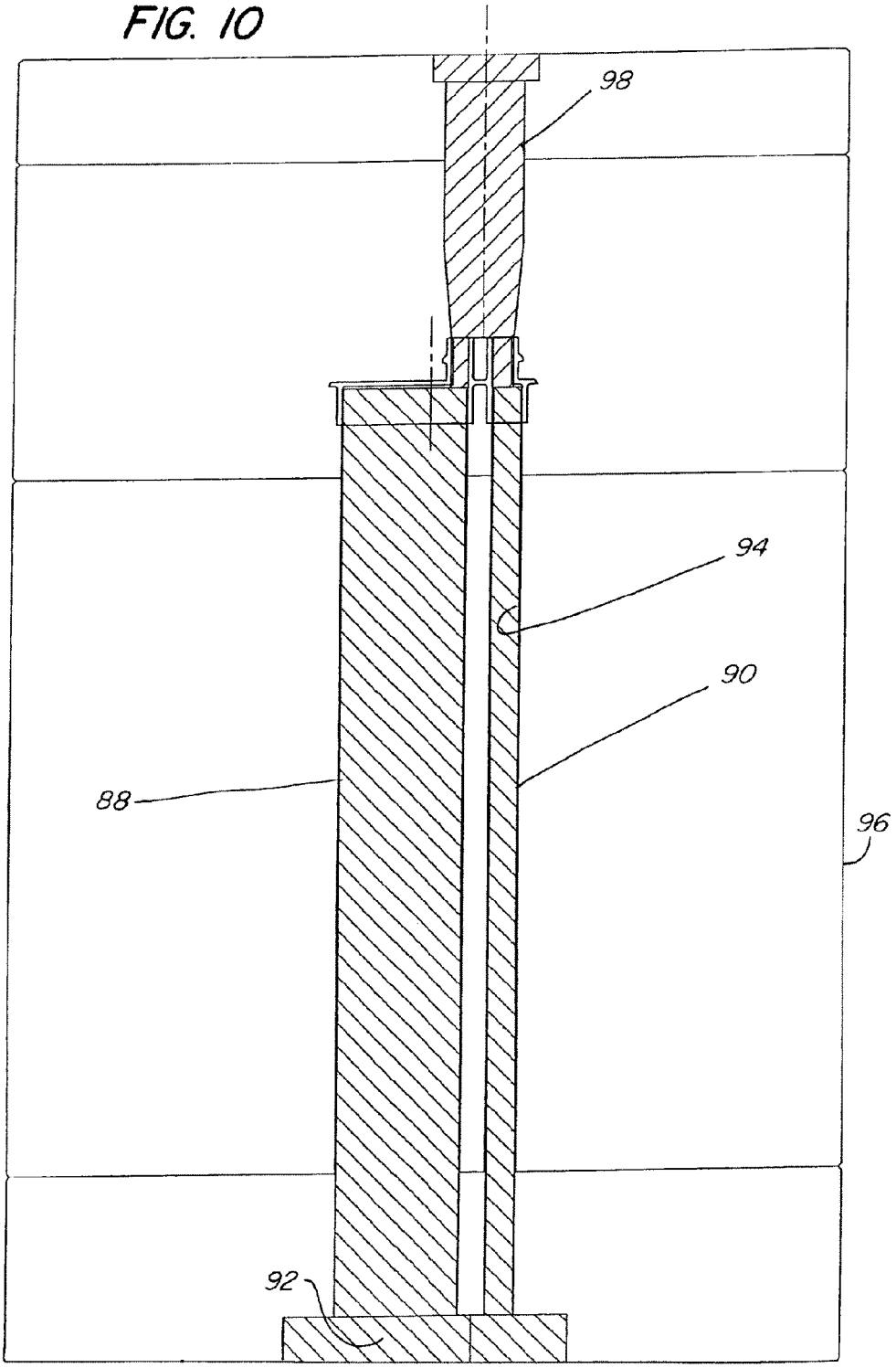
FIG. 10 is a view similar to FIG. 9 for making a film pack container with side-by-side bags.

Turning next to FIG. 10, therein illustrated is the mold assembly for molding and bonding the film bags 52, 54 to the face plate 58 for the embodiment of FIGS. 6-8. A large diameter mandrel 88 and a small diameter mandrel 90 are supported on the base 92 and have the film bags 52, 54 supported thereon in the cavity 94 of the mold 96. The secondary core 98 cooperates with the mold cavity 94 to provide a cavity portion in which the ends of the film bags 52, 54 are exposed so that resin will flow thereabout to form the face plate 58 and bond the components. After cooling, the mandrel assembly is withdrawn from the mold 96 and the face plate and film bags are removed therefrom to provide the empty film pack container.

Figure 11:
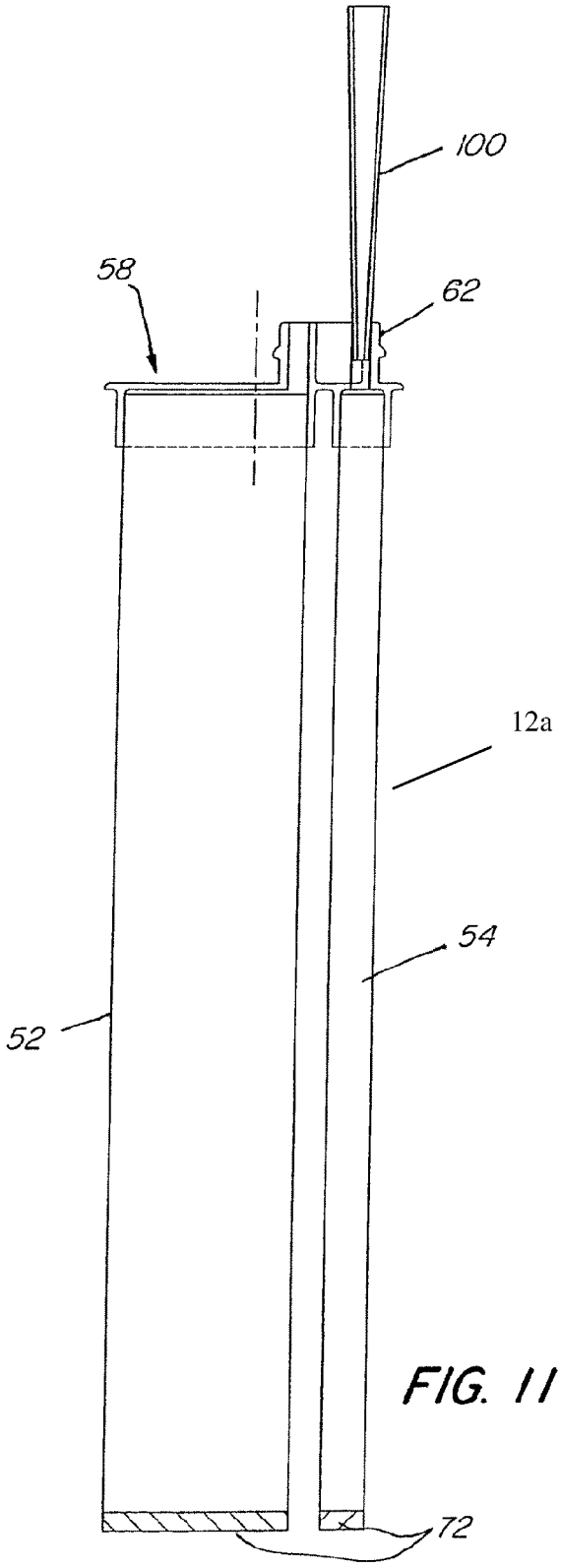
FIG. 11 is a diagrammatic view of the film bag/face plate assembly with a dispenser tube coupled to the face plate for introduction of a flowable composition into one of the bags.
Figure 14:
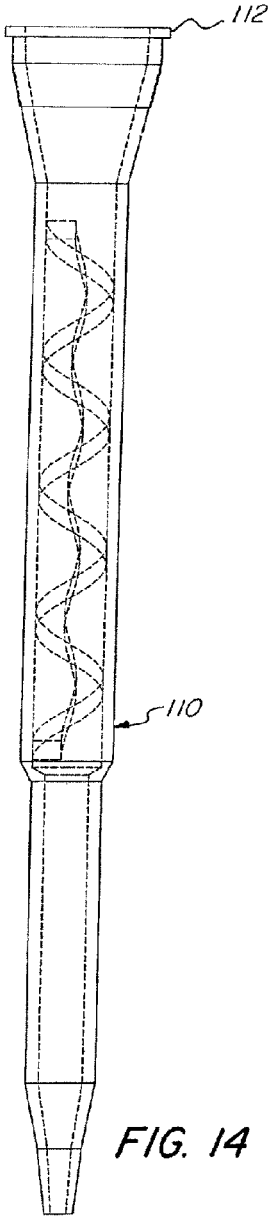
FIG. 14 is a longitudinal view of a static mixer for use in accordance with an embodiment of the invention.
Figure 13A:
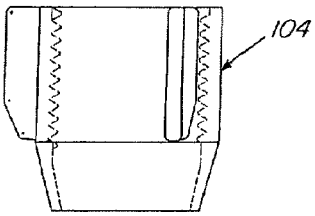
FIGS. 13*a* and 13*b* are respectively side and front views of a coupler for use in accordance with an embodiment of the invention.
Figure 12A:
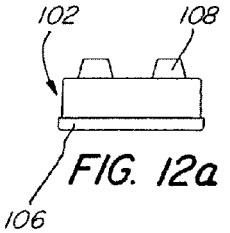
FIGS. 12*a* and 12*b* are respectively side and rear elevational views of a cap for use in accordance with an embodiment of the invention.
Figure 12B:
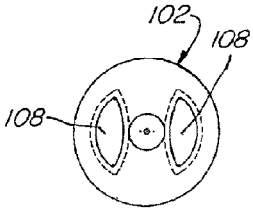
Figure 13B:
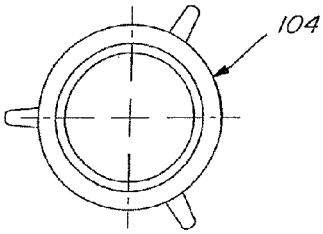
Figure 15:
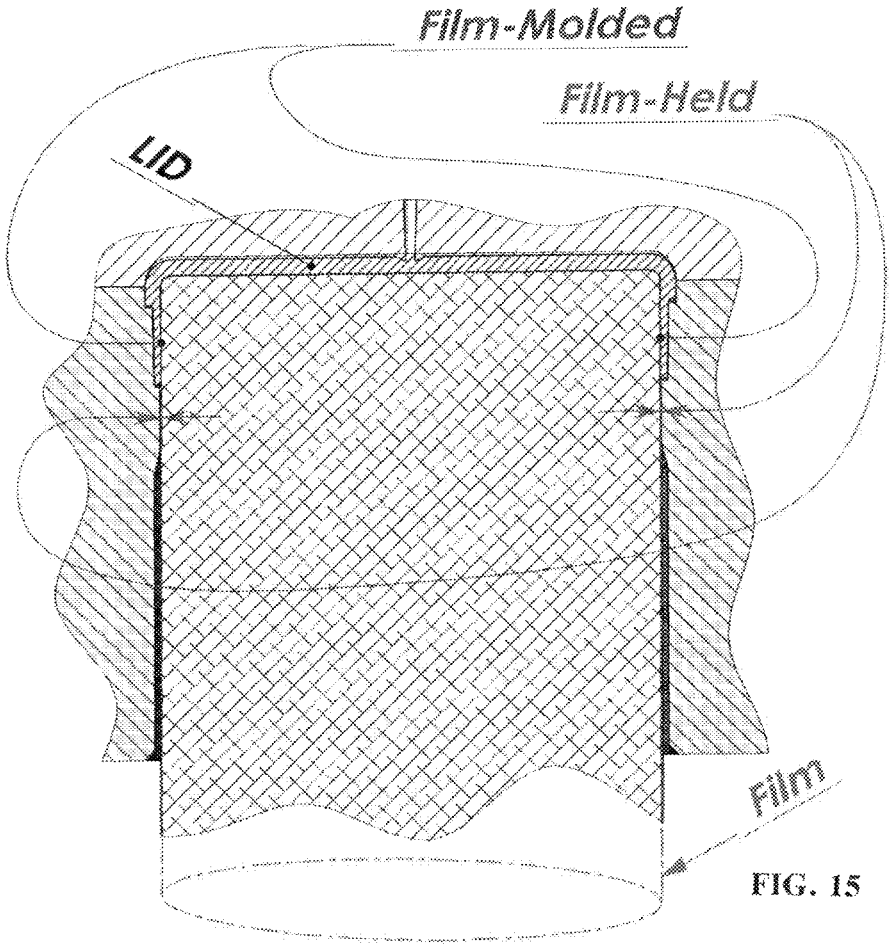
FIG. 15 is a diagrammatic illustration of a mold cavity film and overmolded face plate in accordance with an embodiment of the invention.

Turning next to FIG. 11, an empty film pack container 12*a* is supported on a fixture (not shown), and air is evacuated from the film bags 52, 54. A first flowable composition is injected into the small film bag 54 through the fill tube 100 which is seated in the face plate 58. Generally, the flowable composition will extend into the nosepiece 62. After the film bag 54 is filled, a similar fill tube (not shown) is inserted into the nosepiece 62 and a flowable composition is injected into the large film bag 52.

Turning now to FIGS. 12*a* and 12*b*, and FIGS. 13*a* and 13*b*, after the film bags have been filled, the cap generally designated by the numeral 102 is secured to the nosepiece 62 by the internally threaded coupler generally designated by the numeral 104 which bears against a flange 106 on the cap 102 and threads onto the nosepiece 62. The cap 102 has portions 108 which extend into the nosepiece 62.

The coupler 104 also serves to mount the static mixer generally designated by the numeral 110 since the coupler 104 bears against the flange 112 of the mixer 110.

Figure 16:
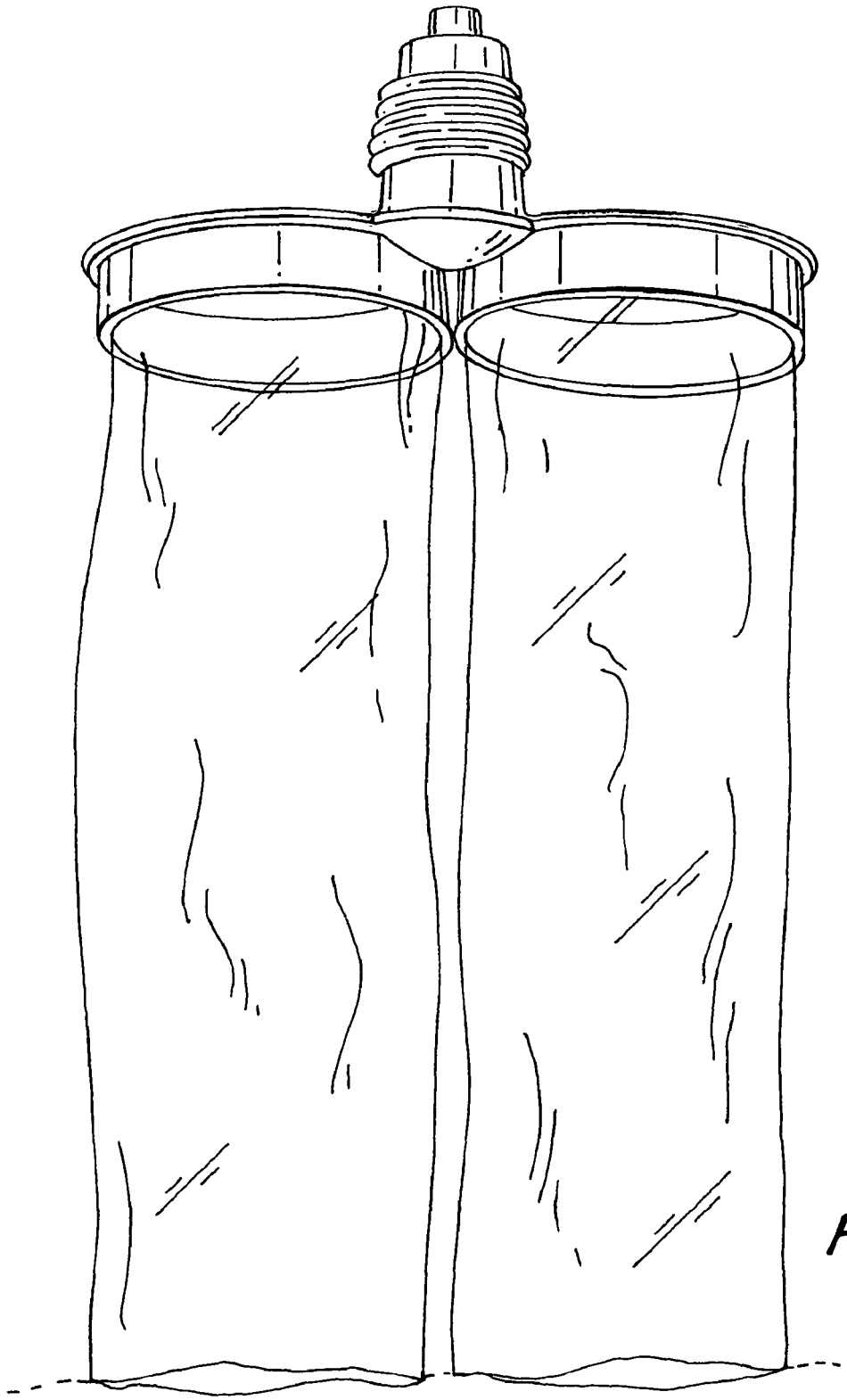
FIG. 16 is a drawing of a dual film bag prior to filling and sealing of the lower end in accordance with an embodiment of the invention.

FIG. 16 is a drawing of a dual film pack container sold commercially by Applicant's assignee. The film bags are side by side and the face plate is disposed about the end of the tubular film bags.

Figure 17A:
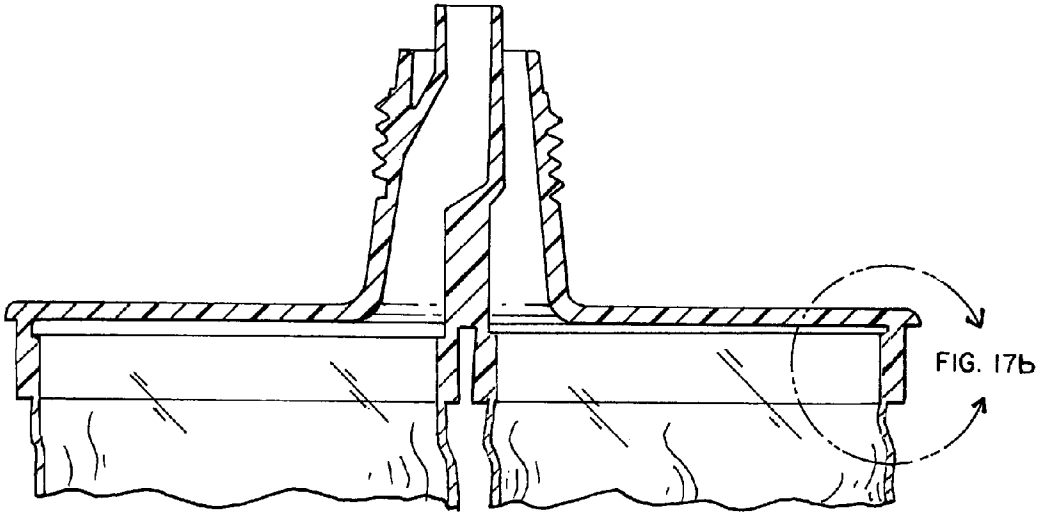
FIGS. 17*a* and 17*b* are drawings of a fragmentary single bag in accordance with an embodiment of the invention.

FIG. 17*a* is a drawing of a dual film bag and face plate.

Figure 17B:
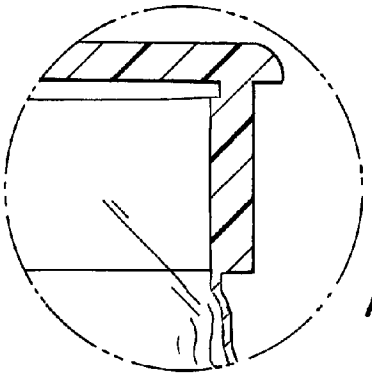

FIG. 17*b* is a drawing of an enlarged fragmentary portion of FIG. 17*a*.

Figure 18:
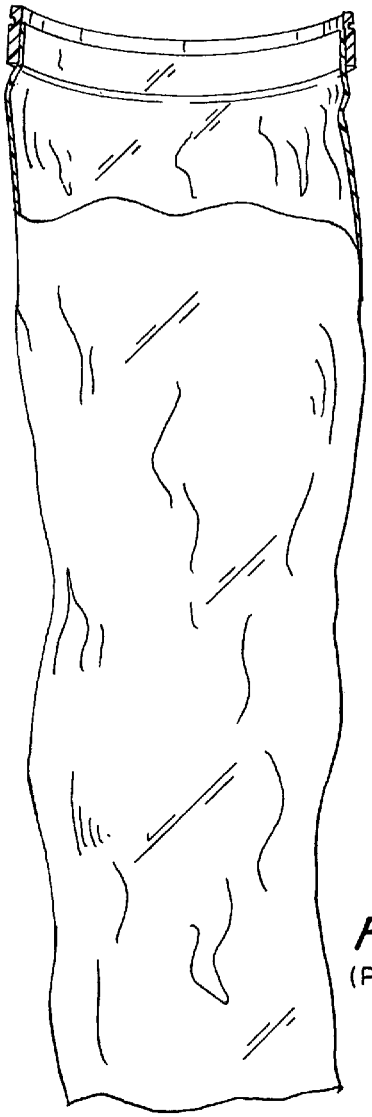
FIG. 18 (PRIOR ART)
FIG. 18 is a drawing of a single bag from what is understood to be a licensee of Konuma and made in accordance with U.S. Pat. No. 5,593,066.

FIG. 18 is a drawing of a single film bag container made in accordance with the Konuma et al patent.

Figure 19:
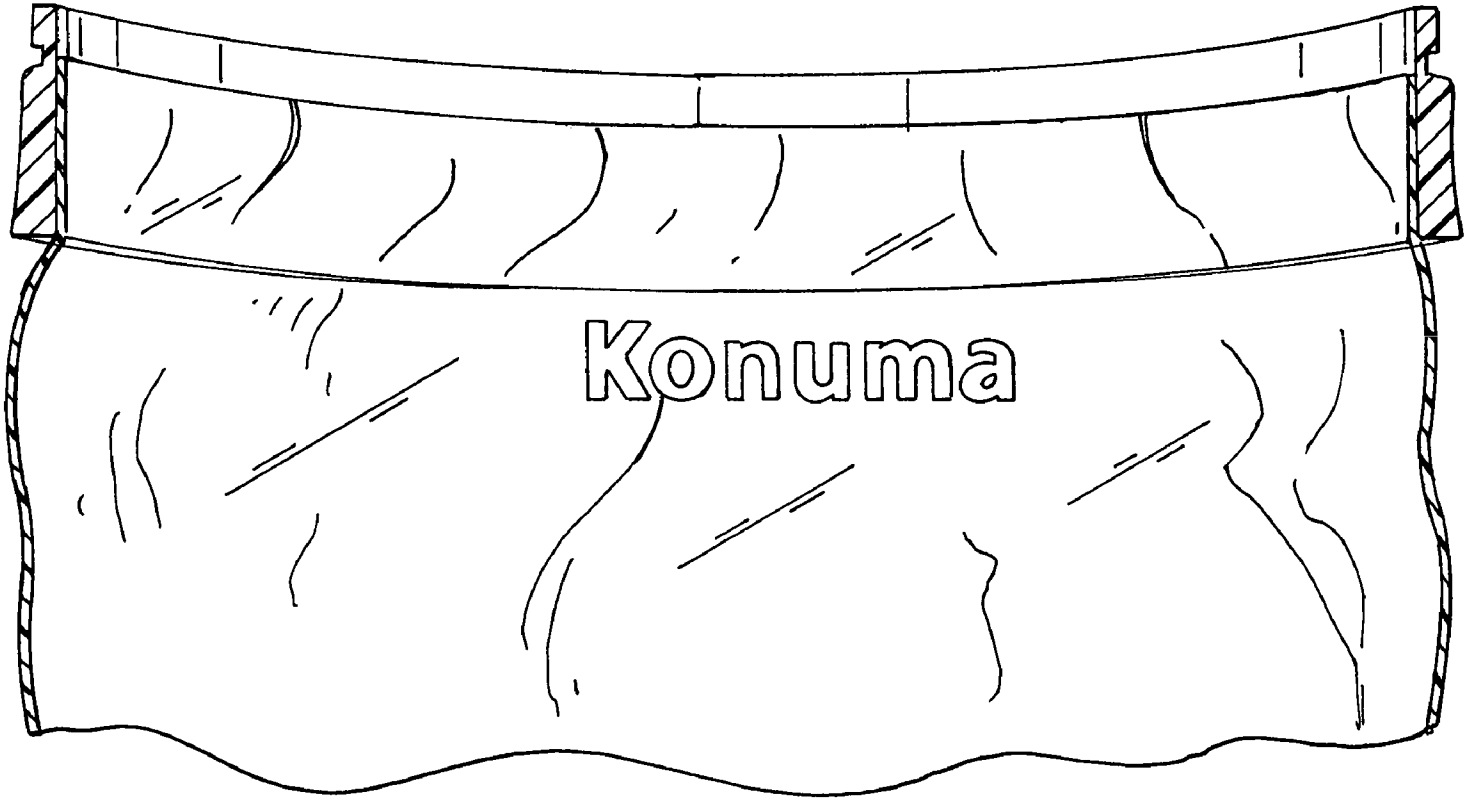
FIG. 19 (PRIOR ART)
FIG. 19 is a drawing of an enlarged fragmentary portion of the film bag of FIG. 18 with a base closure member engaged with the lower end of the tubular film bag.

FIG. 19 is an enlarged fragmentary view of the Konuma film bag reinforcing member assembly. The film bag is placed about the periphery of the reinforcing member and is adhered to the outer surface of the reinforcing member.

By supporting the upper ends of the mandrel in a properly configured mold cavity, the molten resin will flow about the upper end of the film bag and cause it to become molten and intermix with the molten resin flowing into the cavity.

As used herein, the term "discharge" opening includes single partitioned openings and spaced, separate openings. The configuration and size will vary with the volume to flow therethrough and the film bag configuration.

As used herein, the term "synthetic resin" includes homopolymers and interpolymers, and various additives including fillers, reinforcing elements, etc. In the instance of the film bags, it includes not only homogenous films but also laminates of different resins with and without additives. A preferred resin is polypropylene, but polyethylene and nylon may also be used. For some applications, it is desirable to use a composite film with a center layer of nylon and inner and outer layers of polypropylene.

As used herein, the term "substantially identical" composition refers to resins of similar chemistry which will bond strongly. In the instance of laminates, the resin layer providing the surface of the bag to be bonded to the face plate should be substantially identical to that of the resin of the face plate so that the bag will firmly bond thereto.

The film bags are generally formed from tubular film cut to the desired length. Although blown film is preferable, flat film may be formed into a tube with bonded overlapping edges.

Bonding of the ends of the bags remote to the face plate can be effected by adhesives, heat, sonic welding, and other readily available techniques.

Applicant's process of overmolding the face plate on the exterior of the film eliminates secondary operations with premolded members.

It can be seen that an embodiment of the present process permits use of film bags of laminated films including one or more resins providing desired properties such as resistance to attack by the contents better bonding and mixing of the resins of the film and face plates.

In contrast, microscopic analysis of the film/reinforcing member of Konuma shows multiple defined layers, whereas the overmolding in accordance with an embodiment of the invention produces an integrated structure of essentially uniform composition in which the film bag is disposed inwardly of the face plate and there are no distinct layers at the interface.

Various flowable compositions may be used in the film packs including sealants, adhesives, protectants, paints and other coating materials, foams, etc. The film bag exposed thereto and the face plate should have a composition which will not be adversely affected thereby.

The mixed components exiting the static mixer can be applied directly or sprayed by use of a pressurized air source and a suitable nosepiece assembly, which is discussed further below.

The dimensioning (cross sectional area) of the bags in a film pack will allow proportionating the two components to be mixed. For a 1:1 ratio, the film bags have the same cross sectional area. For a 3:1 ratio, one of the film bags will have a cross sectional area which is three times that of the other. When the relative viscosity of the compositions or the ratios warrants, the discharge openings may also be customized to facilitate or retard flow therethrough.

The discharge opening may assume several different configurations but should provide partitioning of the flowable compositions until after they have passed into the nosepiece. Moreover, the configuration and dimensioning of the separate portions may provide a restriction for one of the flowable compositions to accommodate variation in viscosity, different ratios, etc.

The film bags are filled by injecting the flowable compositions through the discharge opening(s). After sealing the opposite end of the film bags, the face plate can be mounted on a fixture which allows the film bags to extend vertically downwardly. A vacuum may be drawn on the film bags through the nosepiece to facilitate the filling of the film bags without having to vent air from the film bags as they are being filled, or a nitrogen purge may be used. Alternatively, the film bags may have a porous vent to permit air to pass therethrough but not the composition being introduced into the film bag.

The dispensers conveniently use as sleeves cylindrical tubes of synthetic resin, spiral wound paperboard, metal and laminates which can be reused. By use of shuttles acted on by the pusher of the piston, the shuttles are moved in the sleeve against the film bags to compress them. When the film packs are only partially discharged, the static mixer can be removed and discarded, and the cap is placed on the nosepiece. If the contents are fully discharged, the static mixer is removed and the film pack can be removed from the sleeve; both are discarded. A new film pack can be placed in the sleeve which is rotated end for end before placement in the dispenser. Thus, the shuttle is at the opposite end of the dispenser to be acted upon by the pusher of the piston when the sleeve and film pack container are placed in the dispenser.

Thus, the discharged film pack containers and static mixers are discarded, but the dispensers, sleeves and shuttles are all reusable.

Thus, it can be seen from the foregoing detailed description and attached drawings that the film bag containers according to an embodiment of the invention are relatively simple to fabricate and the components are bonded to provide good sealing. The film bags can be filled easily after assembly of the components.

Turning now to FIGS. 20-25 in which alternative component delivery systems that utilize the aforementioned film bags are depicted.

Figure 20:
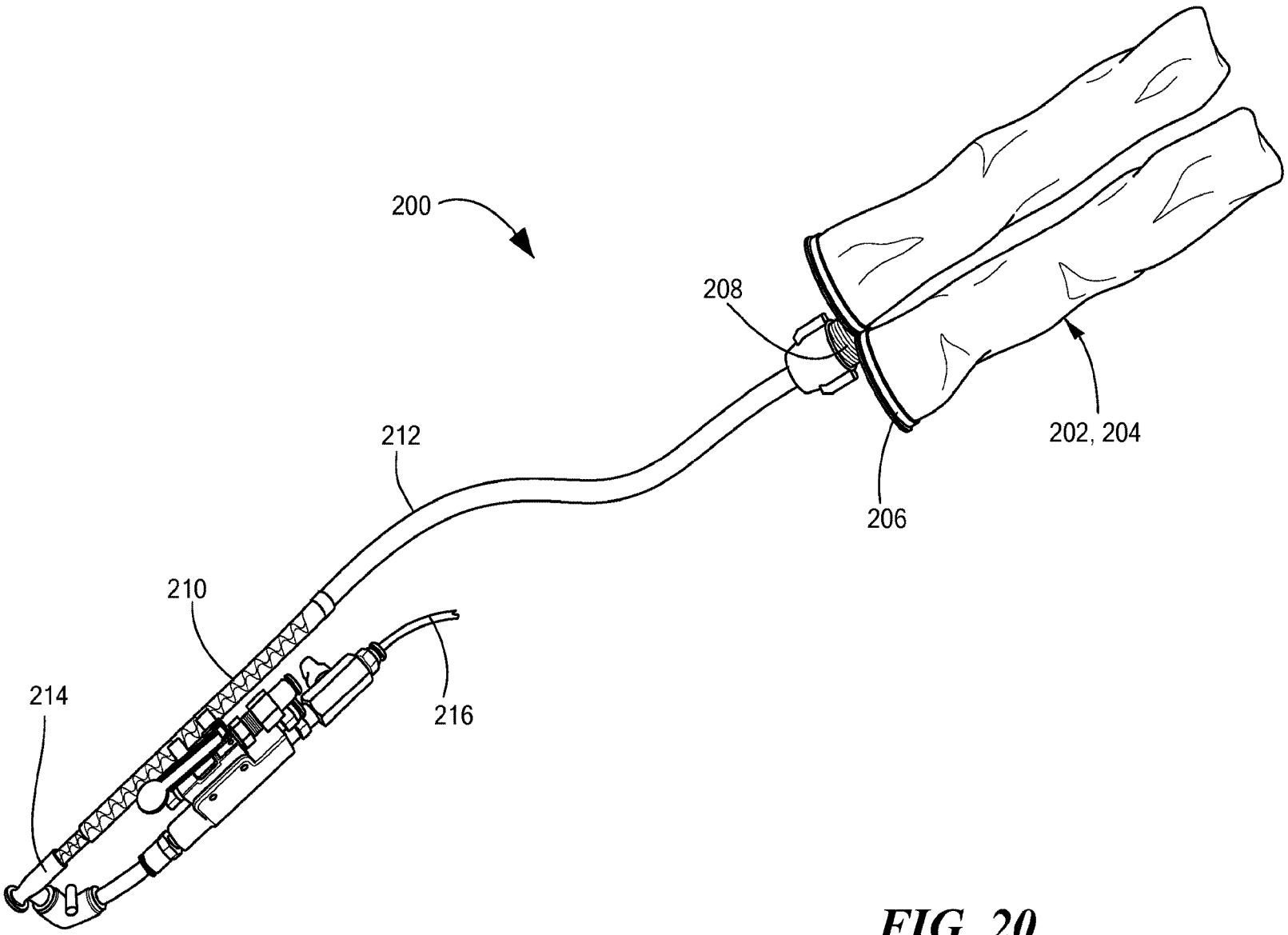
FIG. 20 depicts a first portion of a component delivery system utilizing film bags in accordance with an embodiment of the invention.

FIG. 20 depicts a first portion 200 of a component delivery system that utilizes two flexible film bags 202, 204 (similar to film bags 26, 28). The two flexible film pack bags 202, 204 have a common rigid face plate 206 (similar to face plate 30) with a discharge nosepiece 208 (similar to nosepiece 36) integrally formed therewith. The discharge nosepiece 208 has a partition (best seen with reference to partition 48 in FIG. 3) internally disposed and configured to maintain separate flow streams from respective ones of the two flexible film pack bags 202, 204. A mixer 210 (similar to static mixer 50) is disposed in fluid communication with the flow streams from respective ones of the two flexible film pack bags 202, 204 via a first flexible tube 212 disposed on an upstream side of the mixer 210. In an embodiment, the flexible tube 212 is a single tube that fluidly connects the mixer 210 to the nosepiece 208, and can be of any length suitable for a purpose disclosed herein, which typically would be a length limited by the potting time of the two components from the two film bags 202, 204 as they travel, and partially mix while they travel, through the flexible tube 212. In an embodiment, a material applicator 214, such as a spray tip for example, is disposed in fluid communication with and on a downstream side of the mixer 210. A second flexible tube 216 (depicted as a partial length in FIG. 20) is disposed in fluid communication with the material applicator 214 for supplying atomization air to the material applicator 214 via pressurized gas.

Figure 21:
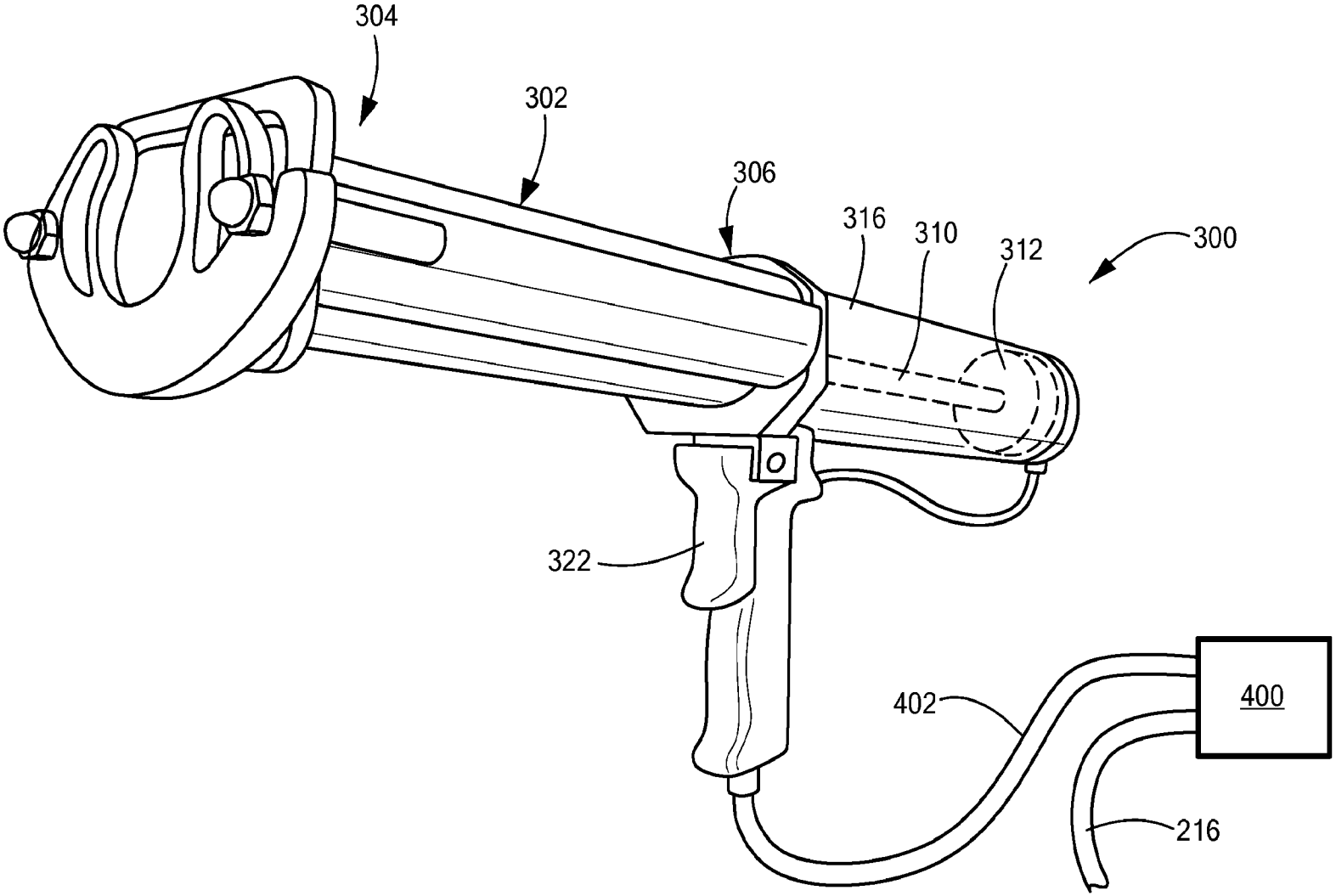
FIG. 21 depicts a second portion of the component delivery system in accordance with an embodiment of the invention.
Figure 24:
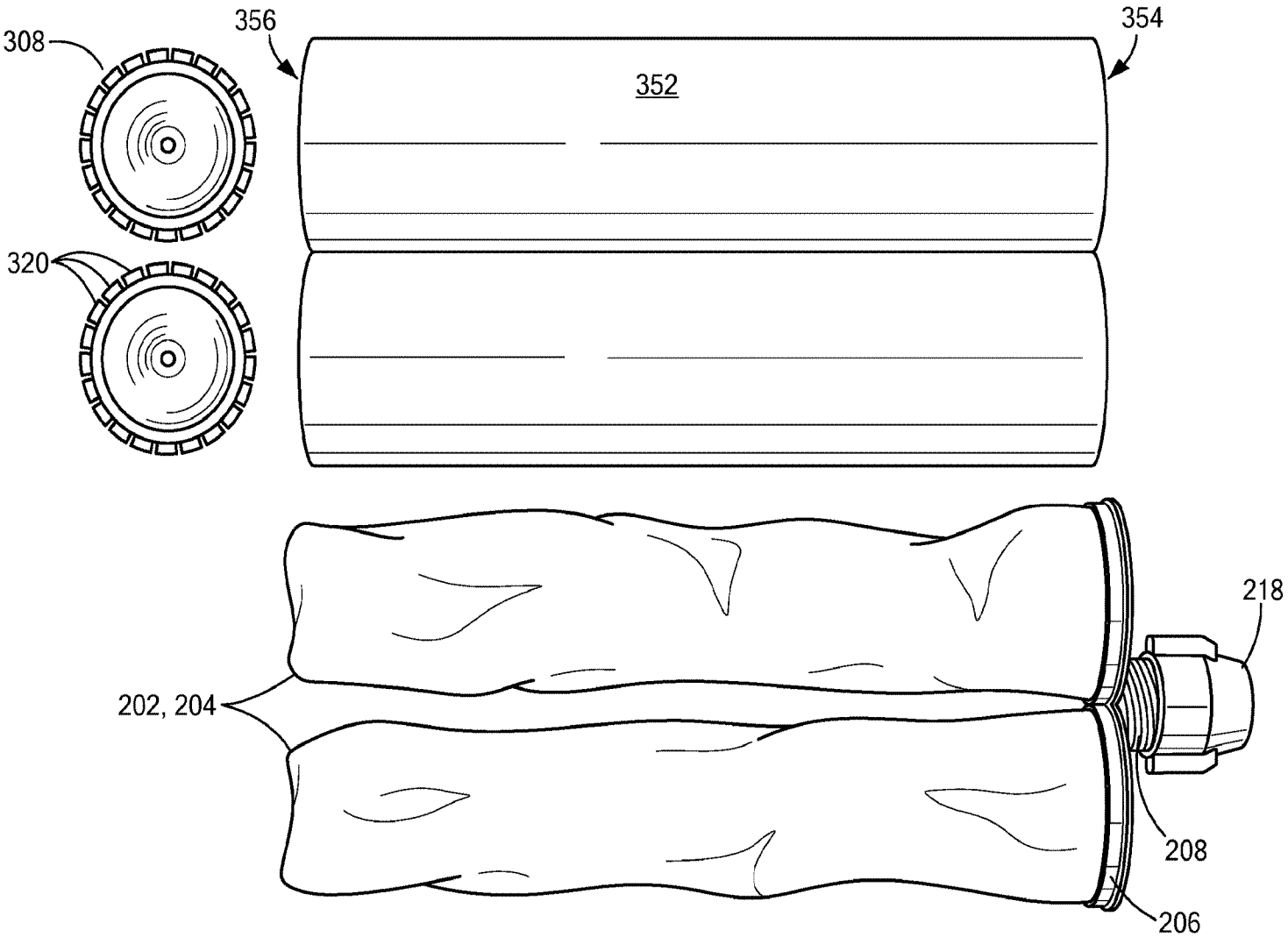
FIG. 24 depicts an alternative arrangement of sleeves, film bags and shuttles, in accordance with an embodiment of the invention.

FIG. 21 depicts a second portion 300 of the component delivery system. In an embodiment, the second portion 300 includes two side-by-side cylindrical sleeves 302 (only one visible in FIG. 21) each having a front end 304 and a back end 306, two shuttles 308 (best seen with reference to FIG. 24) (similar to shuttle 24) are slidingly disposed internal of and proximate the back end 306 of respective ones of the two cylindrical sleeves 302. The two cylindrical sleeves 302 are substantially rigid as compared to the flexible film bags, 202, 204, and can be of any material suitable for a purpose disclosed herein, such as aluminum as depicted in FIG. 21, or plastic as depicted in FIG. 24, which is discussed further below. Two side-by-side push rods 310 (only one visible in FIG. 21) are disposed in operable communication with respective ones of the two shuttles 308, and driven by a piston 312 that is disposed in operable communication with the two push rods 310. Pressurized gas 400 is utilized to drive the piston 312 via a pressurized gas line 402. Flow of the pressurized gas 400 is controlled via a trigger 322. In an embodiment, the pressurized gas 400 is provided by an air compressor for example. The piston 312 has a piston housing 316, and the two cylindrical sleeves 302 are fixedly attached to the piston housing 316. Another end of the second flexible tube 216 is depicted in FIG. 21 connected to the same source of pressurized gas 400. As best seen with reference now to FIG. 22, the front ends 304 of respective ones of the two cylindrical sleeves 302 are configured and adapted to receive individual ones of the two flexible film pack bags 202, 204, which are inserted into the front end 304 of the sleeves 302. In an embodiment, a holder 314 is disposed proximate the front end 304 of respective ones of the two cylindrical sleeves 302 and is configured and adapted to restrain the face plate 206 during dispensing of the flowable material inside the two film pack bags 202, 204. The holder 314 is securable to the two cylindrical sleeves 302 via hardware 318, and movable with respect thereto, pivotable for example, to facilitate loading of the film bags 202, 204 into the two cylindrical sleeves 302.

Figure 23:
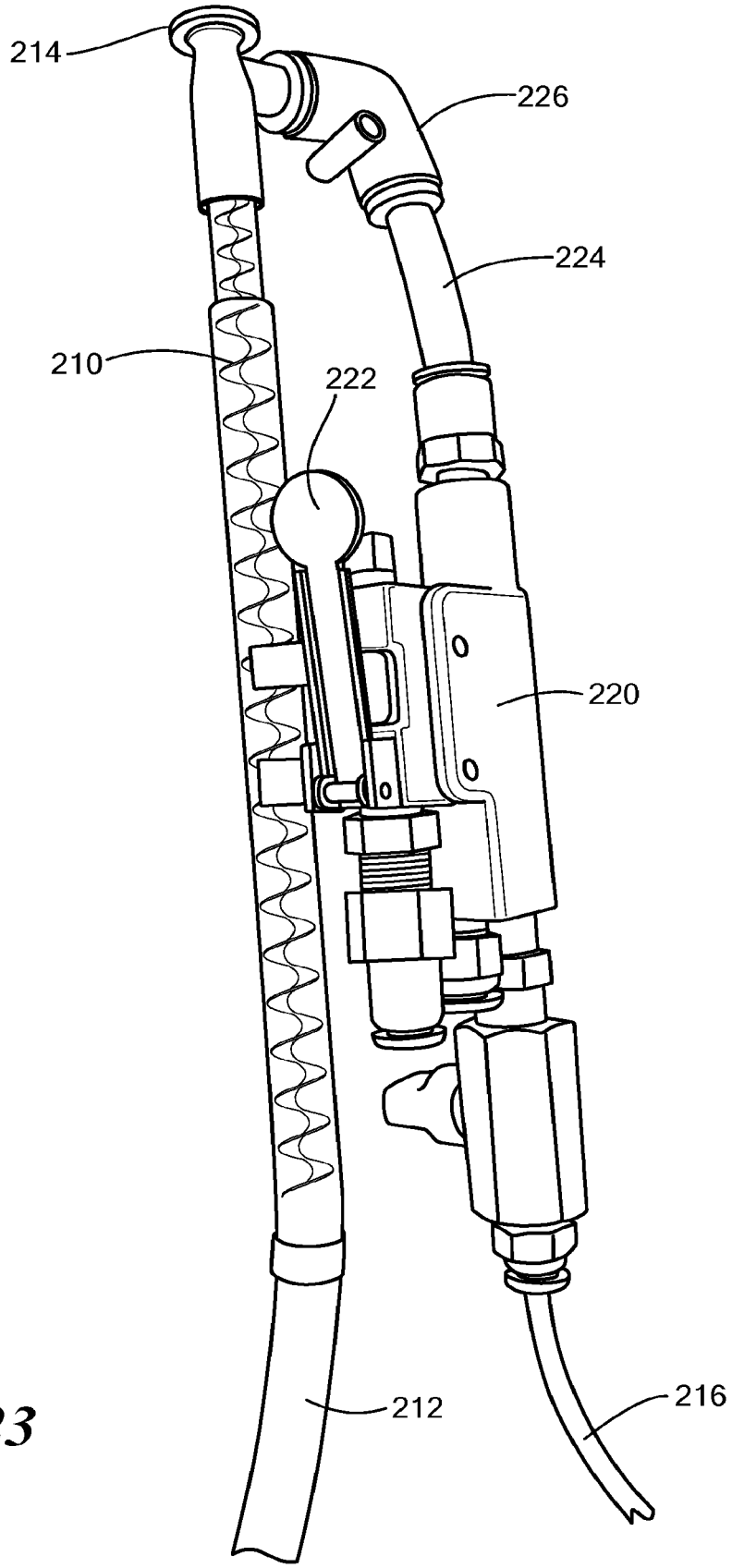
FIG. 23 depicts an enlarged view of the mixing and dispensing section of the first portion of the component delivery system in accordance with an embodiment of the invention.

Reference is now made to FIG. 23, which depicts an enlarged view of the mixing and dispensing section of the first portion 200 of the component delivery system in accordance with an embodiment of the invention. The flowable material from the film pack bags 202, 204 when dispensed via the second portion 300 travel through the flexible tube 212 and through the mixer 210 to the material applicator 214 (spray tip for example). Atomization air from the pressurized gas 400 is provided to a trigger assembly 220 via the flexible tube 216. Actuation of a trigger switch 222 permits the pressurized gas to travel through the connecting tube 224 and the coupling 226 to provide atomization air at the material applicator 214. In an embodiment where the material applicator 214 is a spray tip, the atomization air facilitates spraying of the flowable material, and the flexible tube 216 facilitates spraying in close quarters, such as below ground through a manhole cover for example.

Figure 22:
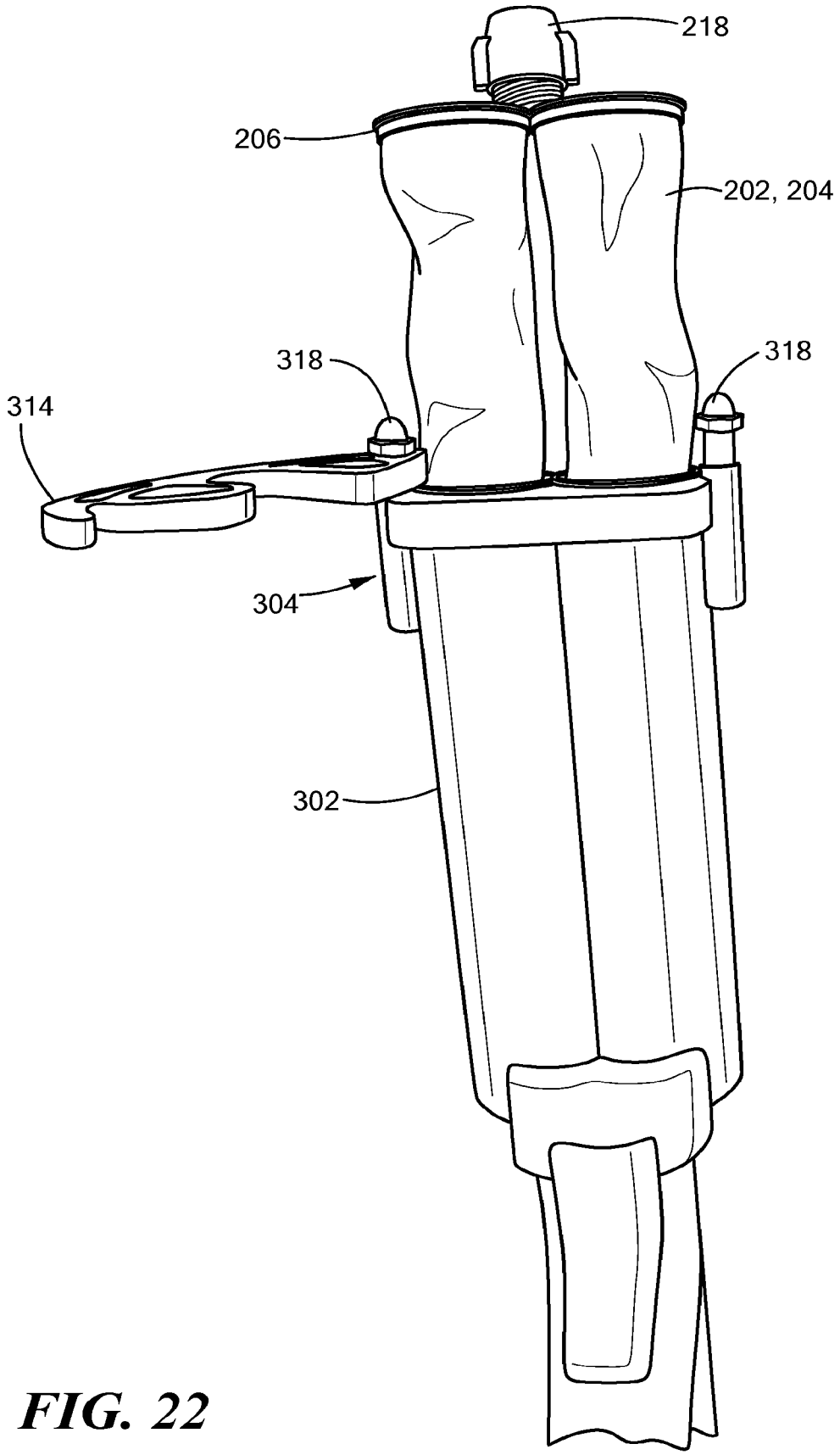
FIG. 22 depicts a partially assembled state of the film bags of the first portion partially installed into sleeves of the second portion of the component delivery system in accordance with an embodiment of the invention.

As mentioned above, the two cylindrical sleeves 302 can be made from any material suitable for a purpose disclosed herein. In FIGS. 21 and 22, example cylindrical sleeves 302 were made from aluminum. With reference now to FIG. 24, an alternative arrangement of two cylindrical sleeves 352, film bags 202, 204, and shuttles 308 is depicted, where the two cylindrical sleeves 352 are made from plastic. Assembly of the film bags 202, 204 into the sleeves 352 is similar to that discussed in connection with FIG. 22, where the two shuttles 308 are inserted into the back ends 356 of the sleeves 352, while the film bags 202, 204 are inserted into the front ends 354 of the sleeves 352. The combination of the film bags 202, 204 in the cylindrical sleeves 352 acts like the film bag container 12 and sleeve 22 in FIG. 1, where the sleeves 352 are also reusable and the expended film bags 202, 204 are disposable. When the combination is assembled into a cartridge form via the sleeves 352, and the film bags 202, 204 are filled with flowable material (discussed above), a sealing cap 218 is placed over the nosepiece 208 to prevent leakage and premature curing of the flowable material inside the film bags 202, 204.

Figure 25:
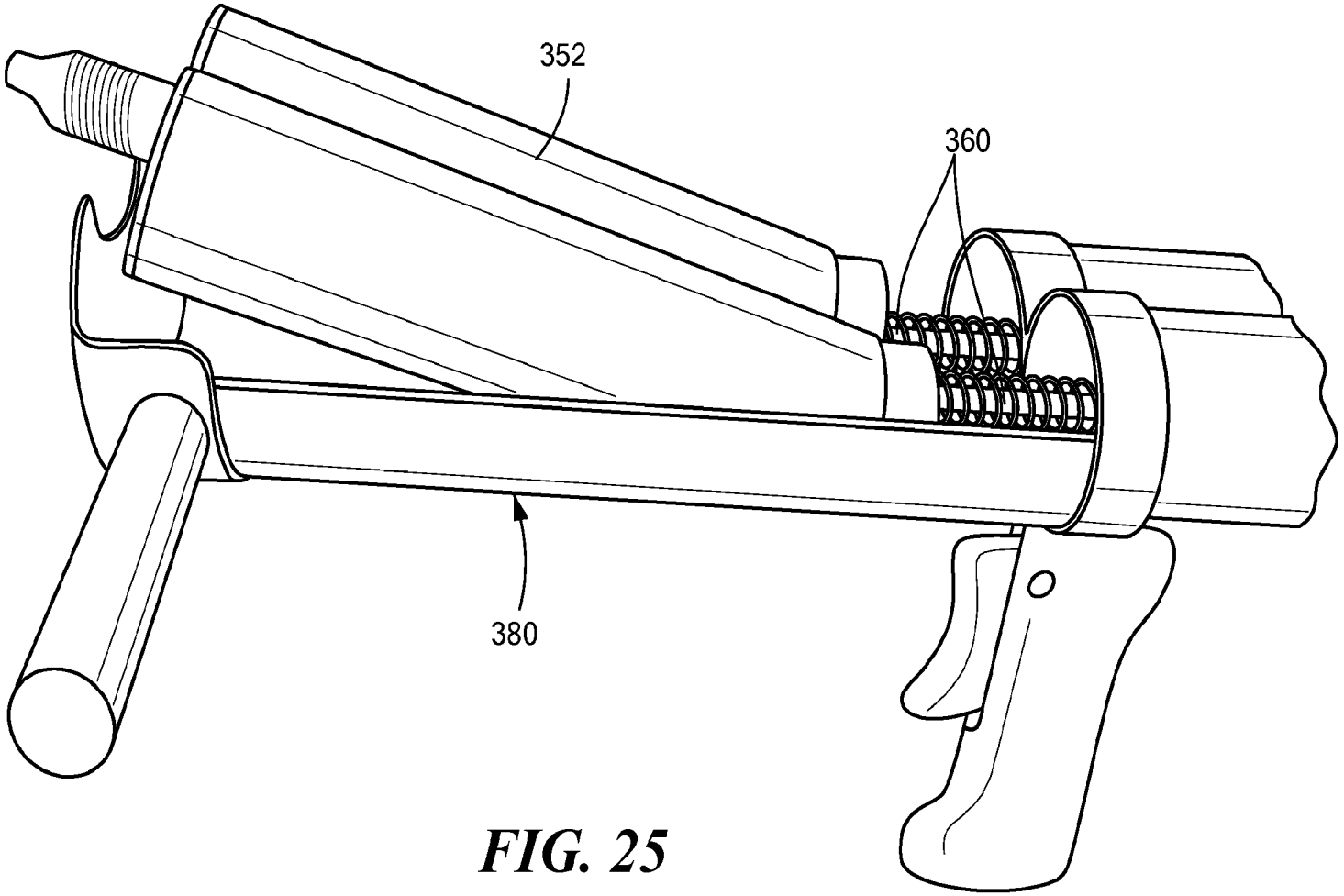
FIG. 25 depicts the alternative sleeves of FIG. 24 being utilized in a cartridge dispenser similar to that depicted in FIG. 1.

To facilitate dispensing of the flowable material from the film bags 202, 204 in the sleeves 352, and with reference now to FIG. 25, a caulking gun type dispenser 380 suitable for dispensing flowable material from a cartridge is employed (similar to the caulking gun 10 in FIG. 1). Similar to the dispensing action discussed above in connection with FIG. 21, the shuttles 308 inside sleeves 352 are driven by two push rods 360, which are driven by a piston (similar to piston 312 for example), which in turn is driven by pressurized gas 400.

With reference now back to FIG. 24, each shuttle 308 has a shape similar to that of a cylindrical disk with an outer cylindrical circumference, and a plurality of individual flexible fingers 320 disposed around the outer circumference. When the shuttles 308 are assembled into their respective sleeves 302, 352, the plurality of flexible fingers 320 of each shuttle 308 flex radially inward in a non-sealing sliding engagement with an interior cylindrical surface of each respective sleeve 302, 352. Spacing between adjacent ones of the flexible fingers 320 permits trapped air inside the sleeves 302, 352 (i.e., between the shuttles 308, sleeves 302, 352, and film bags 202, 204) to escape during a dispensing operation.

While the invention has been described with reference to example embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best or only mode contemplated for carrying out this invention, but that the invention will include all embodiments falling within the scope of the appended claims. Also, in the drawings and the description, there have been disclosed example embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A compressible cartridge, comprising:

a first flexible bag comprising a multilayer film having at least three layers formed from different materials, the first flexible bag having a front end and a sealed back end opposite the front end, and the first flexible bag defining a first volume to receive a first flowable material;

a second flexible bag comprising the multilayer film having the at least three layers formed from different materials, the second flexible bag having a front end and a sealed back end opposite the front end, and the second flexible bag defining a second volume to receive a second flowable material that is different from the first flowable material; and a rigid face plate having a first collar, a second collar, and a nosepiece, the first collar sealingly and non-releasably bonded to the front end of the first flexible bag, the second collar sealingly and non-releasably bonded to the front end of the second flexible bag, the nosepiece defining 1) a first opening that is in fluid communication with the first volume of the first flexible bag, 2) a second opening that is in fluid communication with the second volume of the second flexible bag, and 3) a discharge opening.

2. The compressible cartridge of claim 1, wherein an outer surface of the nosepiece is at least partially threaded.

3. The compressible cartridge of claim 2, wherein the outer surface of the nosepiece is configured to threadingly couple to a mixer.

4. The compressible cartridge of claim 2, wherein the outer surface of the nosepiece is configured to threadingly couple to a sealing cap.

5. The compressible cartridge of claim 1, wherein the nosepiece extends distally and the first and second collars extend proximally.

6. The compressible cartridge of claim 1, wherein the nosepiece comprises a partition to maintain separation of the first flowable material and the second flowable material flowing through the nosepiece.

7. The compressible cartridge of claim 6, wherein the partition extends distally of the discharge opening defined by the nosepiece.

8. The compressible cartridge of claim 1, wherein the first flexible bag is configured to be filled with the first flowable material through the first opening of the nosepiece.

9. The compressible cartridge of claim 8, wherein the compressible cartridge is configured to dispense the first flowable material through the first opening of the nosepiece after the first flexible bag is filled with the first flowable material.

10. The compressible cartridge of claim 9, further comprising a sealing cap configured to seal the first opening of the nosepiece after the first flexible bag is filled but before the first flowable material is dispensed through the first opening of the nosepiece.

11. The compressible cartridge of claim 1, wherein the second flexible bag is configured to be filled with the second flowable material through the second opening of the nosepiece.

12. The compressible cartridge of claim 11, wherein the compressible cartridge is configured to dispense the second flowable material through the second opening of the nosepiece after the second flexible bag is filled with the second flowable material.

13. The compressible cartridge of claim 12, further comprising a sealing cap configured to seal the second opening of the nosepiece after the second flexible bag is filled but before the second flowable material is dispensed through the second opening of the nosepiece.

14. The compressible cartridge of claim 1, wherein:

the at least three layers of the multilayer film comprise an inner layer, a center layer, and an outer layer, the first collar of the rigid face plate being bonded to the outer layer of the front end of the first flexible bag, and the second collar of the rigid face plate being bonded to the outer layer of the front end of the second flexible bag.

15. The compressible cartridge of claim 14, wherein the rigid face plate comprises a material common with the outer layer of the front end of the first flexible bag and the front end of the second flexible bag.

16. The compressible cartridge of claim 14, wherein the common material is polypropylene.

17. The compressible cartridge of claim 1, wherein the first collar and the second collar have different diameters.

18. The compressible cartridge of claim 1, wherein the first collar, the second collar, and the nosepiece are a single piece.

* * * * *